US009635914B2

(12) United States Patent
Fujikura

(10) Patent No.: US 9,635,914 B2
(45) Date of Patent: May 2, 2017

(54) SLING BAG WITH STRAP FASTENING ARRANGEMENT

(75) Inventor: Kazumi Fujikura, Tokyo (JP)

(73) Assignee: KRONGTHIP INNOVATION INC., Tokyo (JP)

( * ) Notice: Subject to any disclaimer, the term of this patent is extended or adjusted under 35 U.S.C. 154(b) by 12 days.

(21) Appl. No.: 13/592,001

(22) Filed: Aug. 22, 2012

(65) Prior Publication Data

US 2013/0168428 A1 Jul. 4, 2013

(30) Foreign Application Priority Data

Dec. 28, 2011 (JP) ..... 2011-288048
Mar. 22, 2012 (JP) ..... 2012-065817

(51) Int. Cl.

| | |
|---|---|
| ***A45F 3/02*** | (2006.01) |
| ***A45C 3/04*** | (2006.01) |
| ***A45C 3/06*** | (2006.01) |
| ***A45C 13/26*** | (2006.01) |
| ***A45C 13/30*** | (2006.01) |

(52) U.S. Cl.

CPC ..... *A45C 3/04* (2013.01); *A45C 3/06* (2013.01); *A45C 13/26* (2013.01); *A45C 13/30* (2013.01); *A45F 3/02* (2013.01)

(58) Field of Classification Search

CPC ..... A45F 3/14; A45F 3/02; A45F 3/04; A45C 3/04; A45C 13/30; A45C 3/06; A45C 13/26; A45C 5/14; Y10S 190/903

USPC ..... 224/626, 625, 578, 579, 600, 627, 580, 224/607; 190/115, 116

See application file for complete search history.

(56) References Cited

U.S. PATENT DOCUMENTS

| | | | | |
|---|---|---|---|---|
| 4,810,102 | A * | 3/1989 | Norton | 383/4 |
| 4,887,751 | A * | 12/1989 | Lehman | A45C 5/14 190/1 |
| 5,797,529 | A * | 8/1998 | Lavine | 224/575 |
| 6,070,776 | A * | 6/2000 | Furnary et al. | 224/627 |
| 6,837,409 | B2 * | 1/2005 | Lemanski, II | 224/579 |
| 8,746,523 | B1 * | 6/2014 | Woolley | 224/578 |
| 2006/0153477 | A1 * | 7/2006 | Koguchi | 383/14 |

* cited by examiner

*Primary Examiner* — Nathan J Newhouse
*Assistant Examiner* — Matthew Theis
(74) *Attorney, Agent, or Firm* — Jackson IPG PLLC; Demian K. Jackson

(57) ABSTRACT

A sling bag is provided with a bag body; a carrying handle secured to the bag body and adapted to wear over the shoulder of a wearer; and a chest strap having one end secured to the bag body and the other end releasably secured to the carrying handle. The carrying handle is adapted to wear over the shoulder of the wearer with the chest strap winding around the chest of the wearer and resting the bag body on the back of the wearer.

2 Claims, 19 Drawing Sheets

SLING BAG WITH STRAP FASTENING ARRANGEMENT

BACKGROUND OF THE INVENTION

1. Field of the Invention

The invention relates to article-carrying bags and more particularly to a sling bag having improved strap fastening arrangement.

2. Description of Related Art

Bags for carrying articles are well known and come in different shapes and sizes. There is demand among the general public for a bag that can be carried in a variety of different positions, such as a shoulder bag over one shoulder and on the back as a backpack. Depending on a person's activity, destination or the things that they are carrying, the person may want to have a variety of different bags for each of those situations. However, if the person's activity, destination or load change while they are away from home, they are unlikely to have a more appropriate bag with them to accommodate the new activity, destination or load. For example, if a person is away from home and are carrying only a few things, they may prefer to have a shoulder bag. However, if they receive gifts or buy things and the weight of their load increases, they may prefer to carry the bag on both shoulders as a backpack.

Sling bags have been commercially available to meet consumers' needs. However, such bags are limited in utility. Further, they are not adaptable.

Japanese Invention Patent Number 10-262,721 and Japanese Utility Model Patent Number 3,110,602 each disclose a sling bag.

Notwithstanding the prior art, the invention is neither taught nor rendered obvious thereby.

SUMMARY OF THE INVENTION

It is therefore one object of the invention to provide a sling bag comprising a bag body; a carrying handle secured to the bag body and adapted to wear over the shoulder of a wearer; and a chest strap having one end secured to the bag body and the other end releasably secured to the carrying handle; wherein the carrying handle is adapted to wear over the shoulder of the wearer with the chest strap winding around the chest of the wearer and resting the bag body on the back of the wearer.

It is another object of the invention to provide a sling bag comprising a bag body comprising a first surface, a second surface, and an open space defined by the first and second surfaces for containing articles; a carrying handle secured to the bag body and adapted to wear over the shoulder of a wearer; and a chest strap having one end secured to the bag body and the other end secured to the carrying handle by securing to the second surface and winding around the first surface; wherein the chest strap is adapted to releasably interconnect one side of the first surface and the other side thereof.

It is still another object of the invention to provide a sling bag comprising a bag body comprising a first surface, a second surface, and a space defined by the first and second surfaces for containing articles, the space having an opening; a first carrying handle secured to the first surface and adapted to wear over the shoulder of a wearer; a second carrying handle secured to the second surface and adapted to wear over the shoulder of the wearer; and a chest strap having one end secured to the bag body and the other end releasably secured to the second surface; wherein one end of the chest strap is adapted to releasably secure to the first surface and the other end thereof is adapted to releasably secure to the first surface.

It is still another object of the invention to provide a sling bag comprising a bag body; a carrying handle secured to the bag body and adapted to wear over the shoulder of a wearer; and a chest strap having one end secured to the bag body; wherein the other end of the chest strap is releasably secured to either the bag body or the carrying handle; and wherein the carrying handle is worn over the shoulder of the wearer when the carrying handle is secured to the other end of the chest strap so that the chest strap winds around the chest of the wearer with the bag body being rested on the back of the wearer.

It is yet another object of the invention to provide a sling bag comprising a bag body comprising a first surface, a second surface, and an open space defined by the first and second surfaces for containing articles; a carrying handle secured to the bag body and adapted to wear over the shoulder of a wearer; and a chest strap having one end secured to the bag body and the other end releasably secured to the carrying handle by securing to the second surface and winding around the first surface; wherein the chest strap is adapted to releasably interconnect one side of the first surface and the other side thereof.

It is a further object of the invention to provide a sling bag comprising a bag body comprising a first surface, a second surface, and a space defined by the first and second surfaces for containing articles, the space having an opening; a first carrying handle secured to the first surface and adapted to wear over the shoulder of a wearer; a second carrying handle secured to the second surface and adapted to wear over the shoulder of the wearer; and a chest strap having one end secured to the bag body; wherein the other end of the chest strap is releasably secured to the second surface; and wherein one end of the chest strap is adapted to releasably secure to the second carrying handle and the other end thereof is adapted to releasably secure to the first surface.

In one aspect of the invention the chest strap is length adjustable.

In another aspect of the invention the chest strap is adapted to either extend or retract toward a long side thereof.

The above and other objects, features and advantages of the invention will become apparent from the following detailed description taken with the accompanying drawings.

DETAILED DESCRIPTION OF THE INVENTION

Figure 1A:
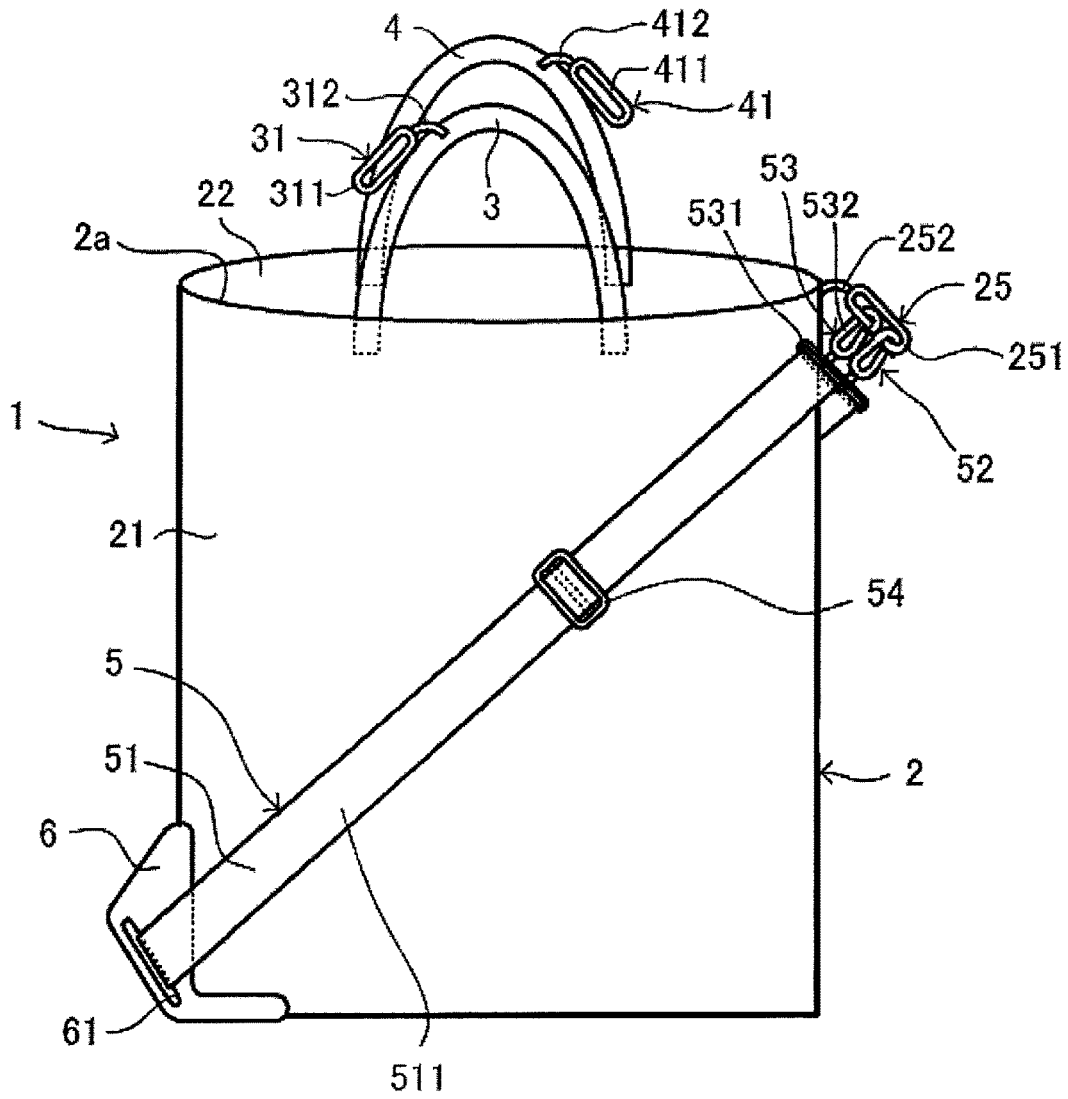
FIG. 1 including parts FIG. 1A and FIG. 1B each are a perspective view of a sling bag according to a first preferred embodiment of the invention but viewing from a first surface and an opposite second surface of the bag respectively.
Figure 1B:
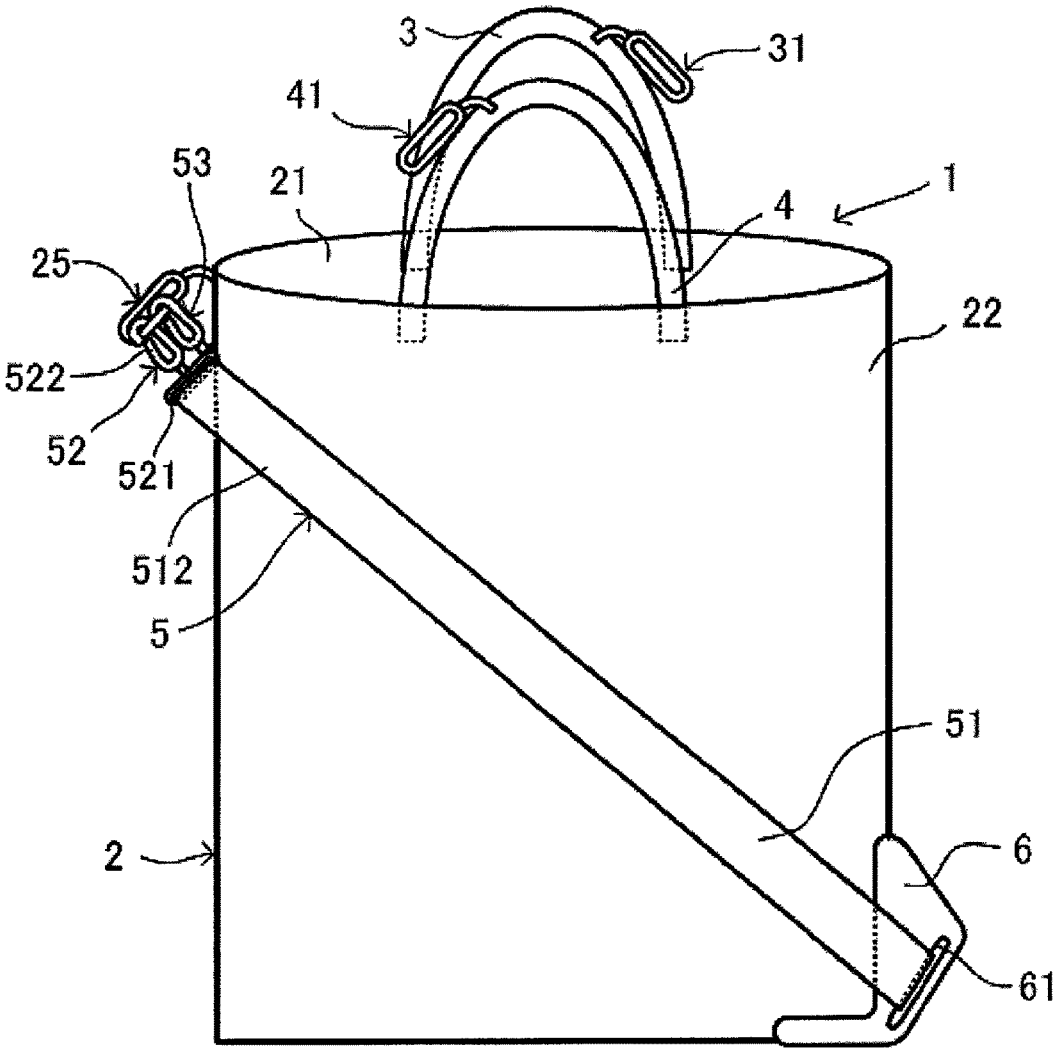
Figure 2:
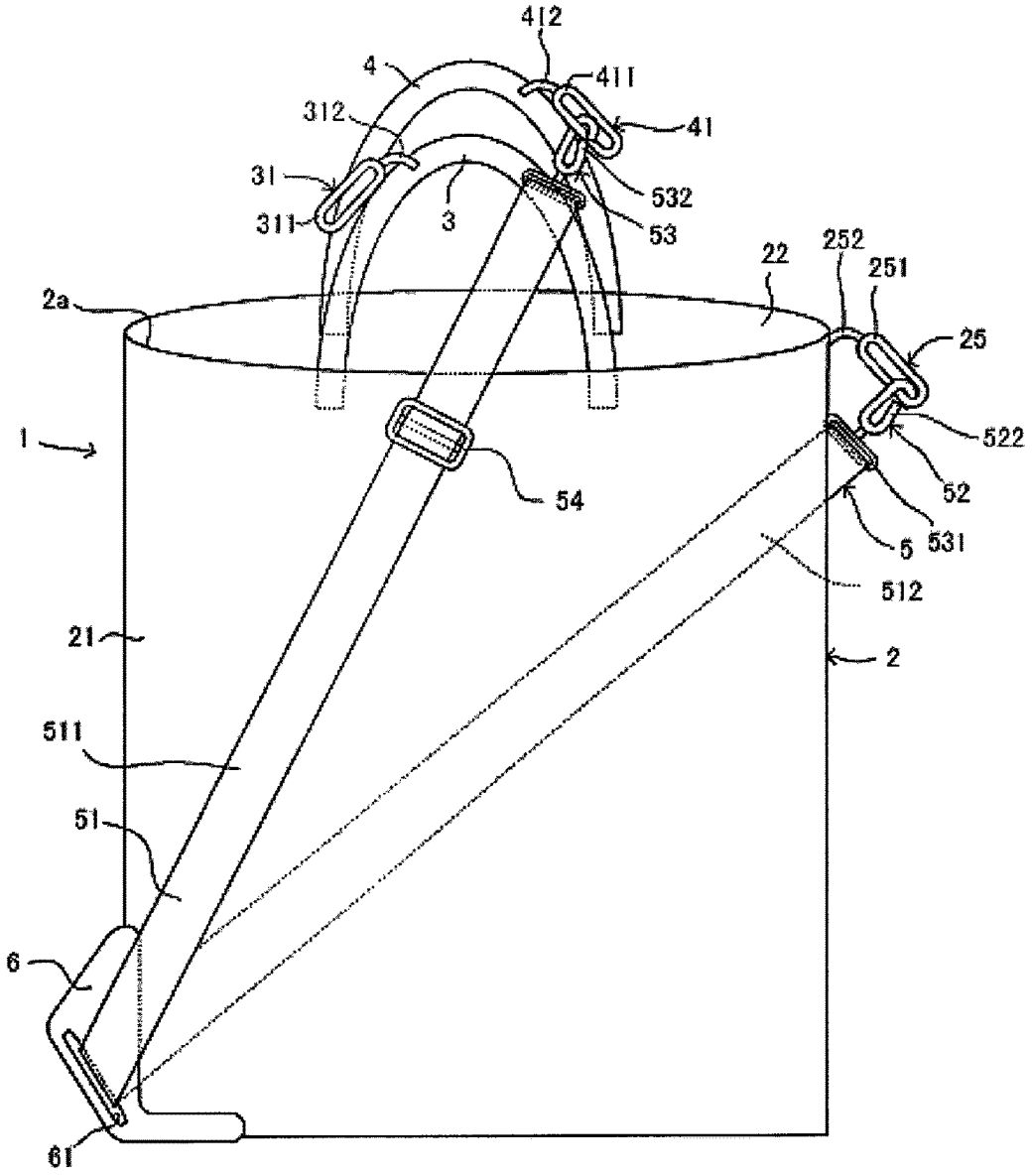
FIG. 2 is a view similar to part FIG. 1A of FIG. 1 showing one end of the strap member of the chest strap attached to a frame on the second carrying handle.
Figure 3:
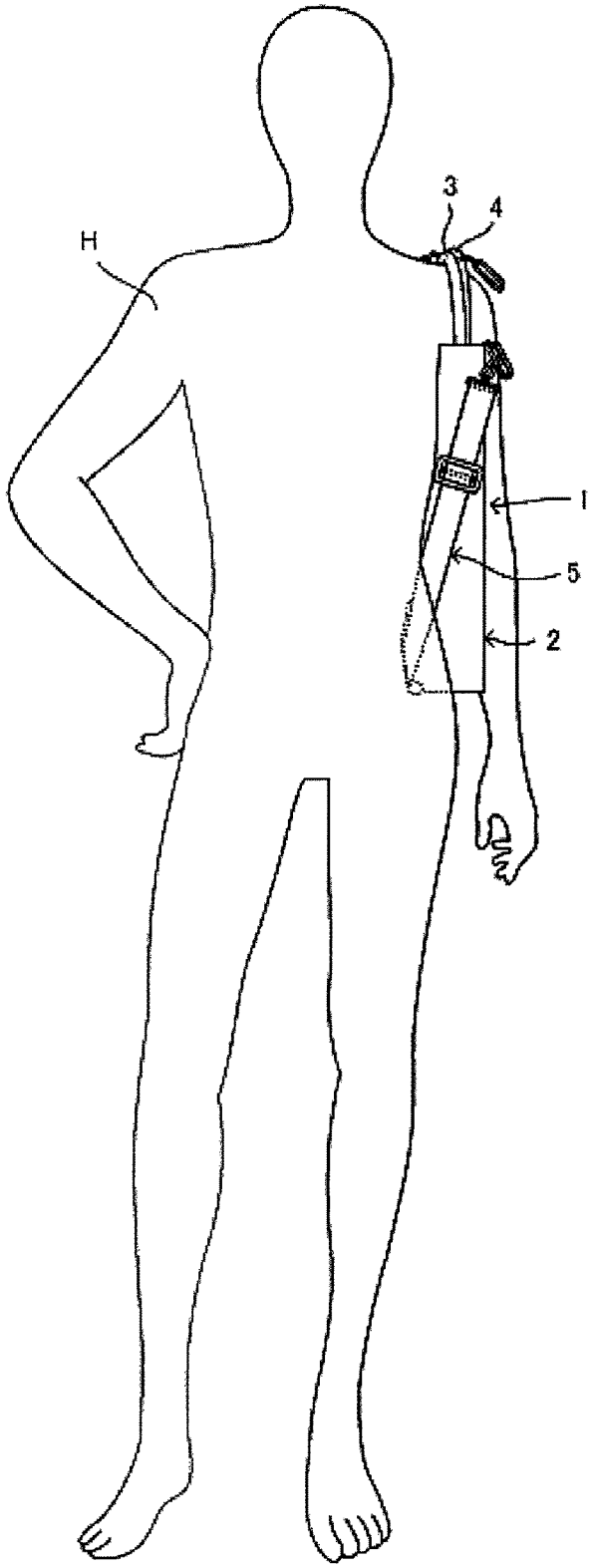
FIG. 3 is a plan view showing a person wearing the bag by resting the first and second carrying handles on his shoulder.
Figure 4A:
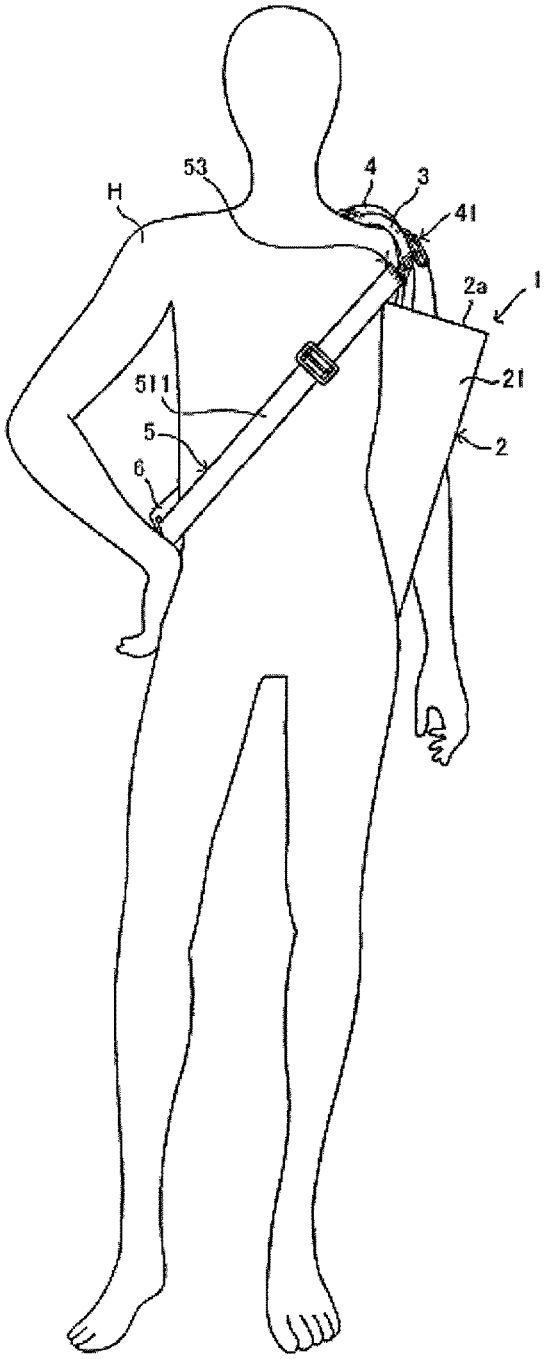
FIG. 4 including parts FIG. 4A and FIG. 4B each are a plan view of a person wearing the bag on his shoulder and winding around the chest and the back but viewing from the front and the back of the person respectively.
Figure 4B:
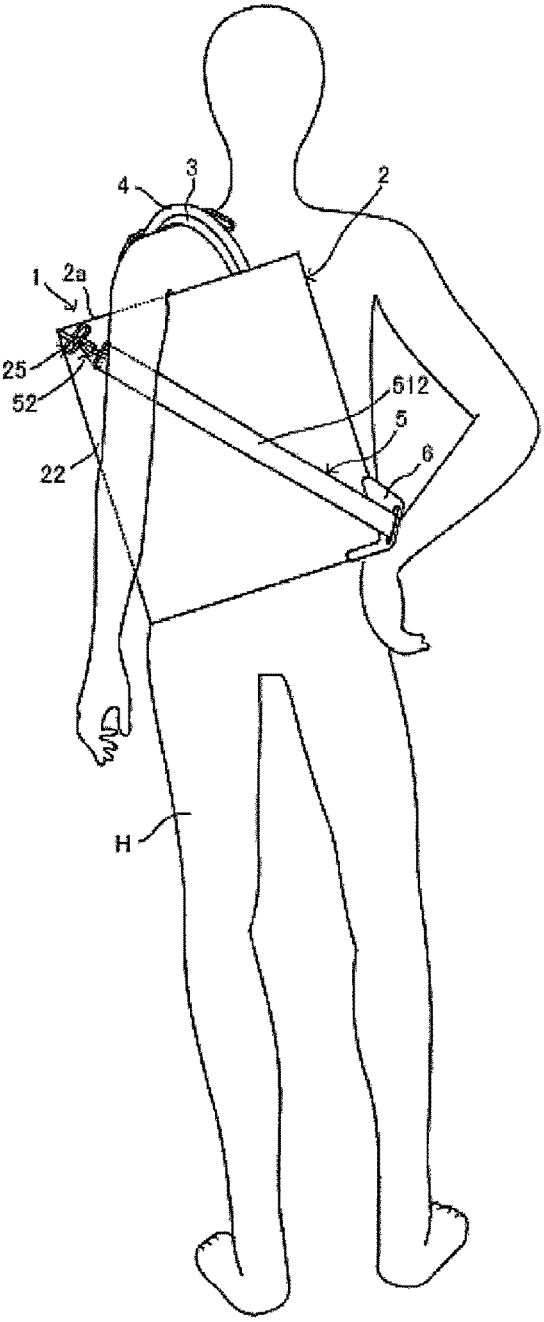
Figure 5A:
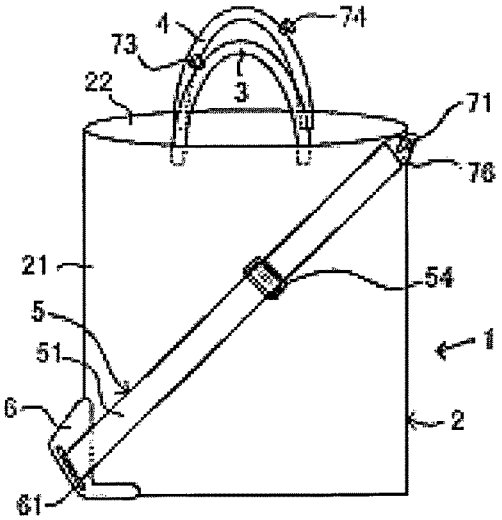
FIG. 5 including parts FIG. 5A, FIG. 5B and FIG. 5C each are a perspective view of the sling bag showing three states of a first configuration of the first preferred embodiment of the sling bag of the invention respectively.
Figure 5B:
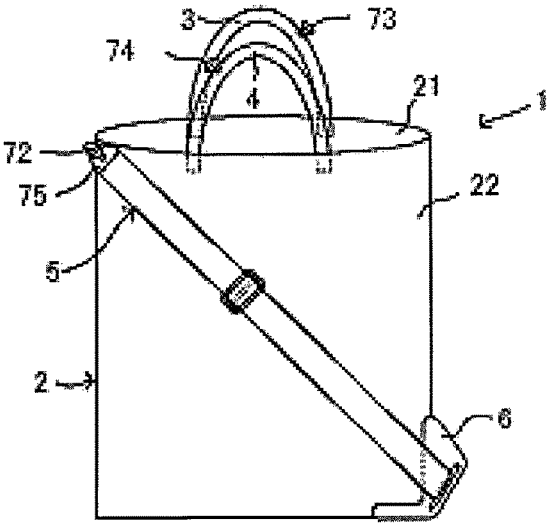
Figure 5C:
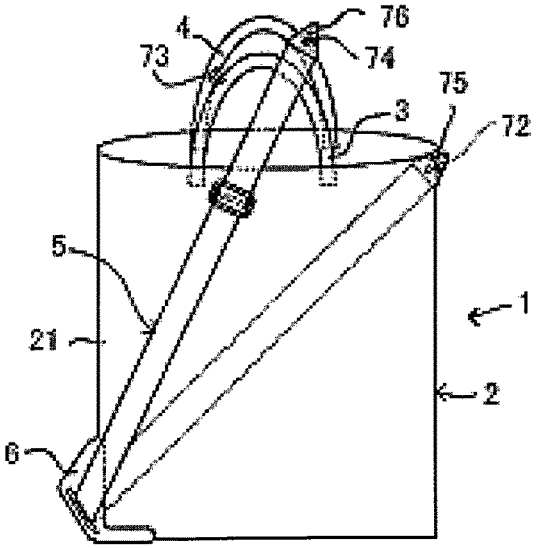
Figure 6A:
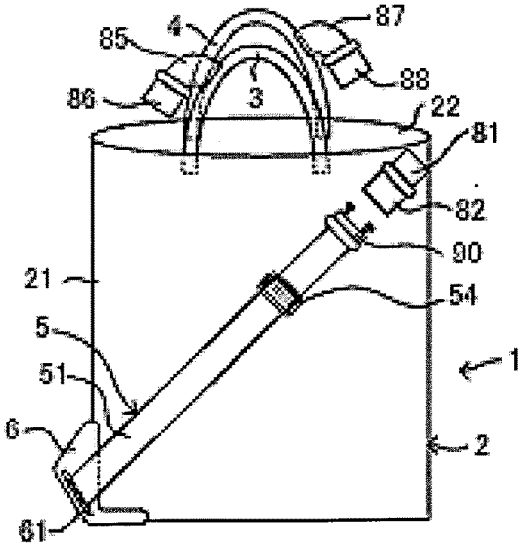
FIG. 6 including parts FIG. 6A, FIG. 6B and FIG. 6C each are a perspective view of the sling bag showing three states of a second configuration of the first preferred embodiment of the sling bag of the invention respectively.
Figure 6B:
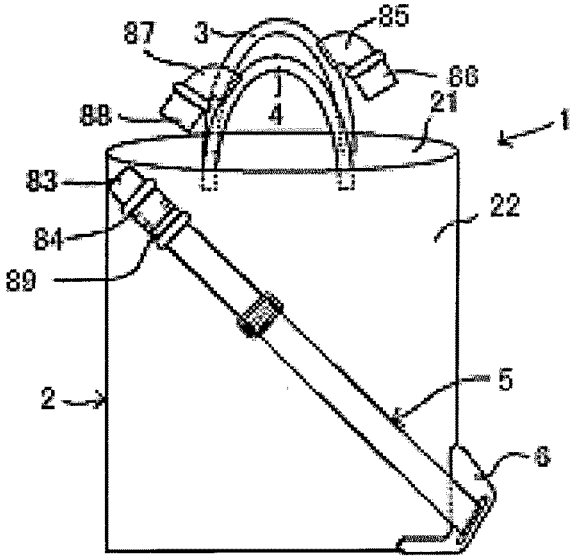
Figure 6C:
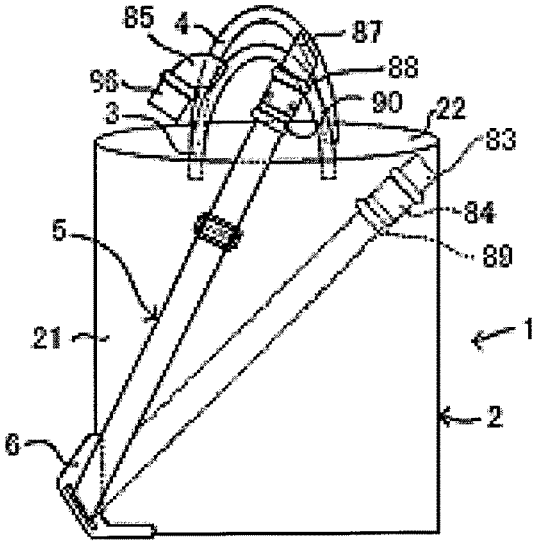
Figure 7A:
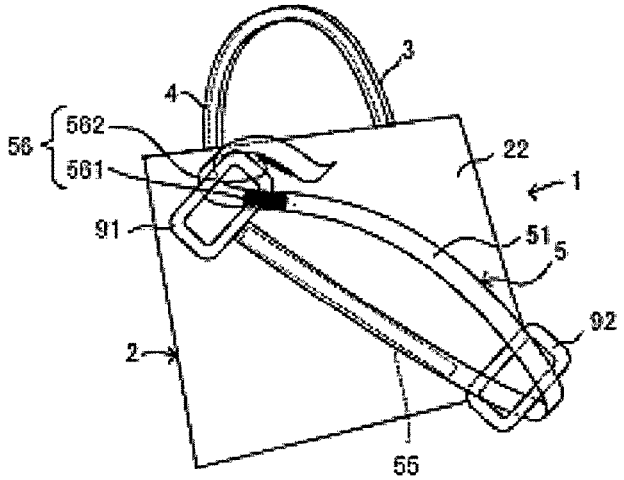
FIG. 7 including parts FIG. 7A, FIG. 7B and FIG. 7C each are a perspective view of the sling bag showing three states of a third configuration of the first preferred embodiment of the sling bag of the invention respectively.
Figure 7B:
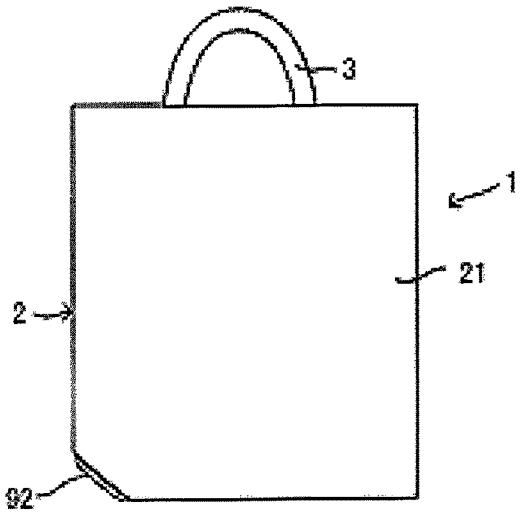
Figure 7C:
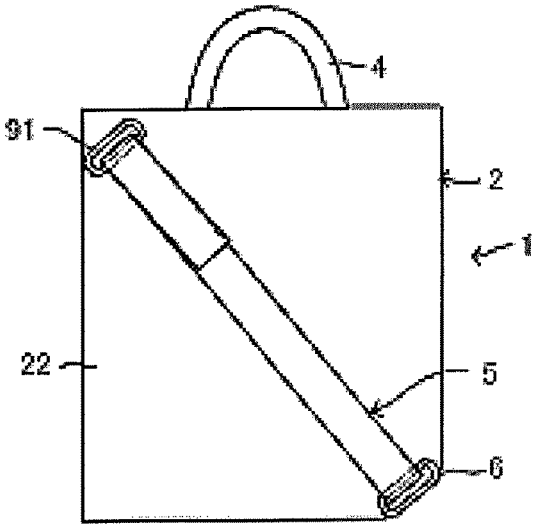
Figure 8A:
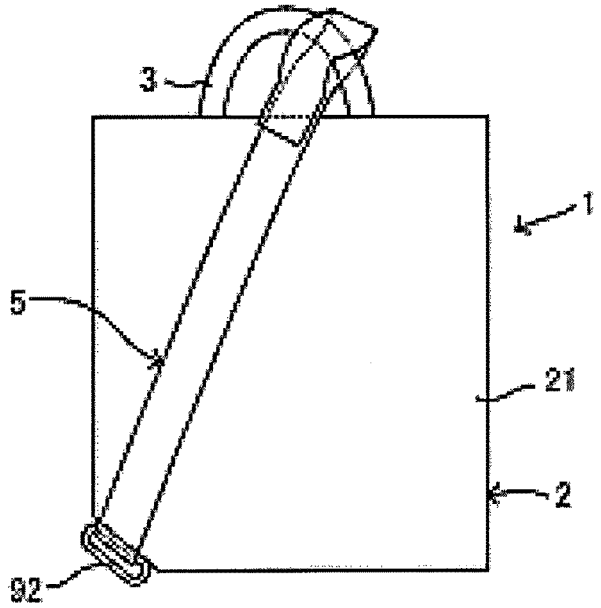
FIG. 8 including parts FIG. 8A and FIG. 8B each are a perspective view of the sling bag showing two states of a fourth configuration of the first preferred embodiment of the sling bag of the invention respectively.
Figure 8B:
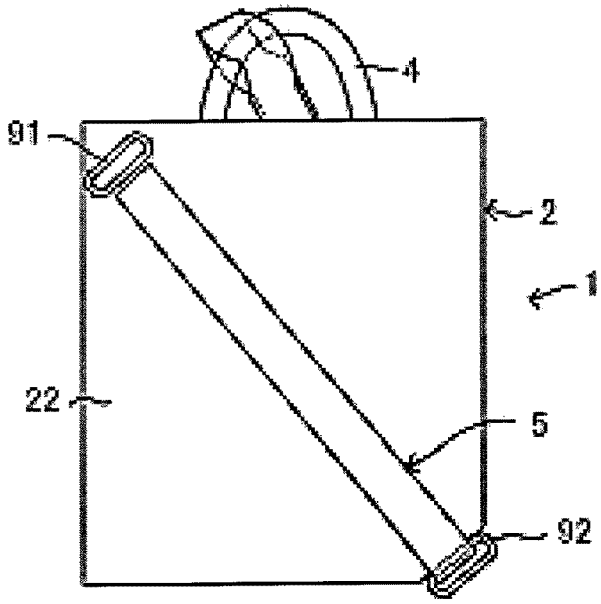
Figure 9A:
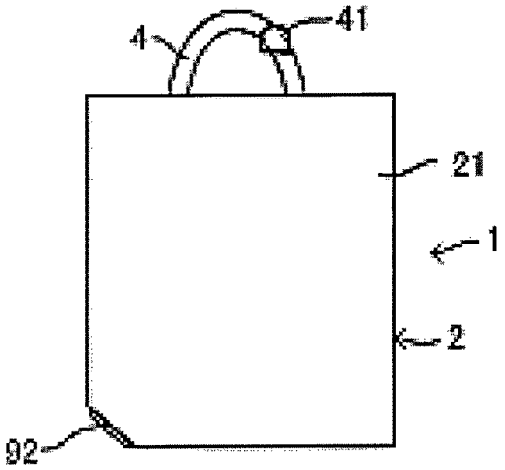
FIG. 9 including parts FIG. 9A, FIG. 9B, FIG. 9C and FIG. 9D each are a plan view of a sling bag according to a second preferred embodiment of the invention but viewing from a first surface, an opposite second surface, the first surface, and the second surface of the bag respectively.
Figure 9B:
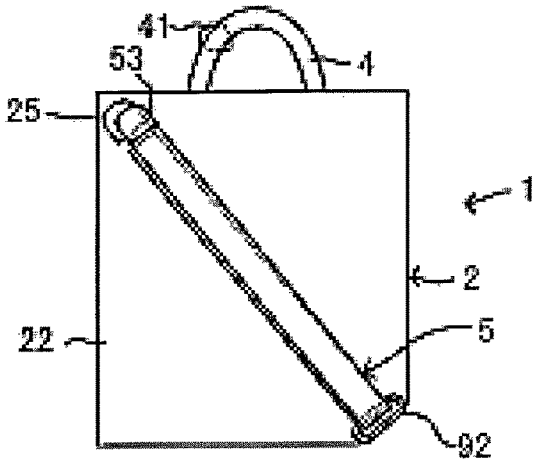
Figure 9C:
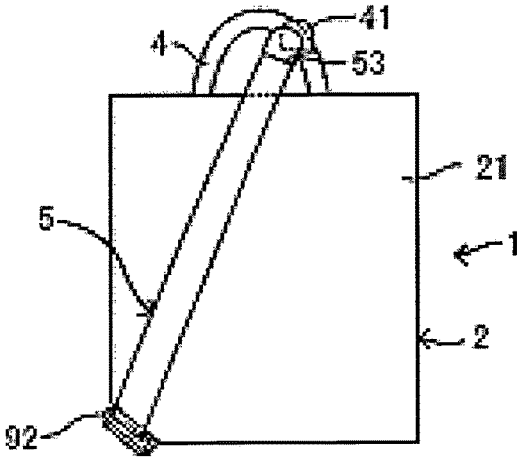
Figure 9D:
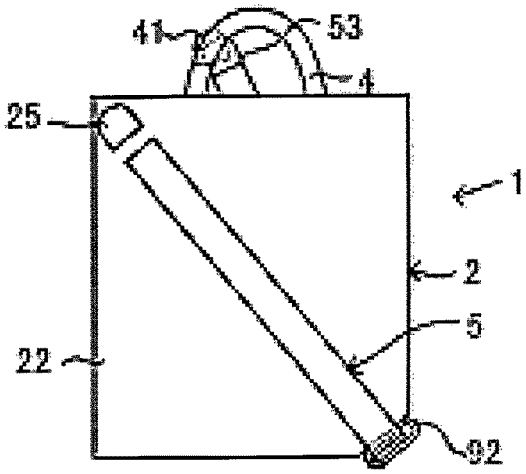
Figure 10A:
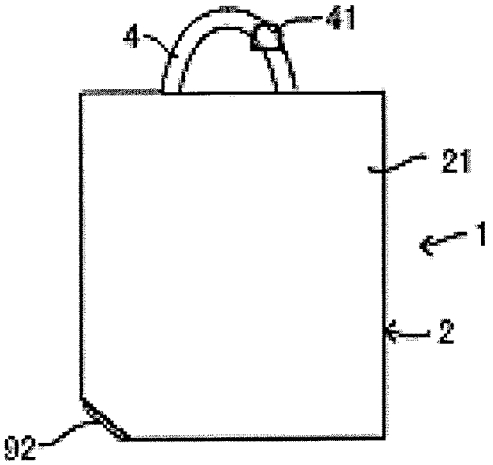
FIG. 10 including parts FIG. 10A, FIG. 10B, FIG. 10C and FIG. 10D each are a plan view of the sling bag showing four states of another configuration of the second preferred embodiment of the sling bag of the invention respectively.
Figure 10B:
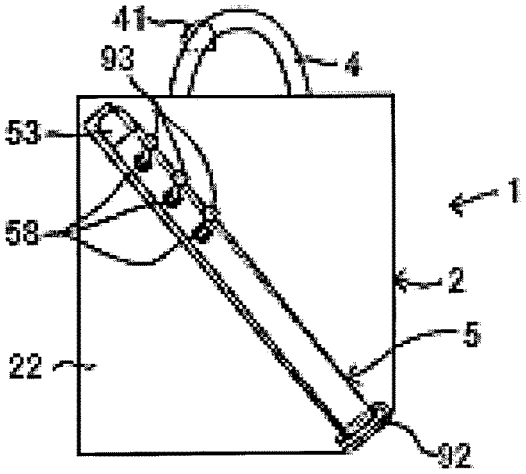
Figure 10C:
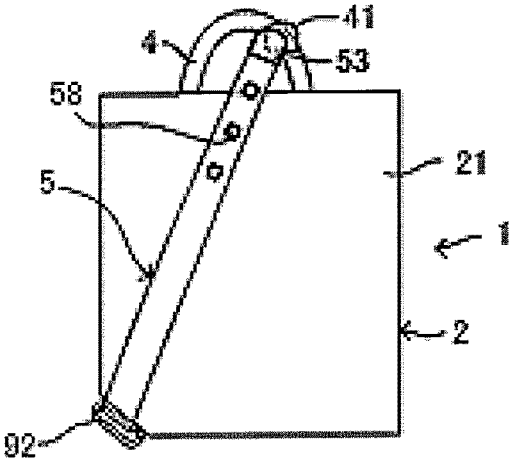
Figure 10D:
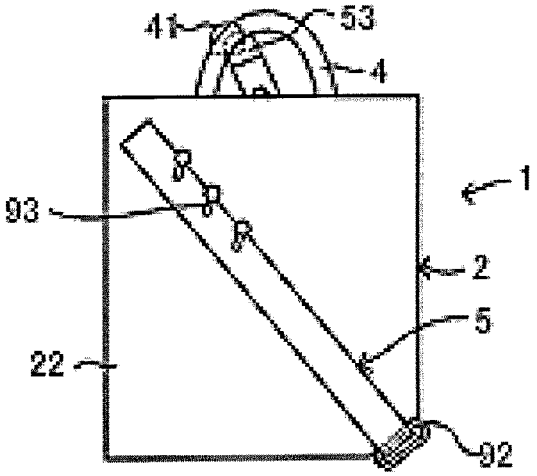

Referring to FIGS. 1 to 8, a bag 1 in accordance with a first preferred embodiment of the invention is shown in which FIG. 1 includes parts FIG. 1A and FIG. 1B each being a perspective view of a sling bag according to a first preferred embodiment of the invention but viewing from a first surface and an opposite second surface of the bag respectively; FIG. 2 is a view similar to part FIG. 1 A of FIG. 1 showing one end of the strap member of the chest strap attached to a frame on the second carrying handle; FIG. 3 is a plan view showing a person wearing the bag by resting the first and second carrying handles on his shoulder; FIG. 4 includes parts FIG. 4A and FIG. 4B each being a plan view of a person wearing the bag on his shoulder and winding around the chest and the back but viewing from the front and the back of the person respectively; FIG. 5 includes parts FIG. 5A, FIG. 5B and FIG. 5C each being a perspective view of the sling bag showing three states of a first configuration of the first preferred embodiment of the sling bag of the invention respectively; FIG. 6 includes parts FIG. 6A, FIG. 6B and FIG. 6C each being a perspective view of the sling bag showing three states of a second configuration of the first preferred embodiment of the sling bag of the invention respectively; FIG. 7 includes parts FIG. 7A, FIG. 7B and FIG. 7C each being a perspective view of the sling bag showing three states of a third configuration of the first preferred embodiment of the sling bag of the invention respectively; FIG. 8 includes parts FIG. 8A and FIG. 8B each being a perspective view of the sling bag showing two states of a fourth configuration of the first preferred embodiment of the sling bag of the invention respectively. The sling bag 1 comprises the following components as discussed in detail below.

A first carrying handle 3 and a second carrying handle 4 are provided on opposite edges of a top opening 2*a* of a bag body 2. A diagonally oriented, closed chest strap 5 is provided from top right corner to bottom left corner of the bag body 2 (see part FIG. 1A of FIG. 1) and further to top right corner of the bag body 2 (see FIG. 1B of FIG. 1). A strap retaining member 6 is provided at bottom left corner of the bag body 2 (see part FIG. 1A of FIG. 1) or bottom right corner of the bag body 2 (see part FIG. 1B of FIG. 1).

The bag body 2 is formed of fabric and has a first surface 21 of rectangular and a second surface 22 of rectangular together forming an open space (i.e., space having the opening 2*a*) for containing articles. The opening 2*a* can be open or closed by providing a zipper, a button, etc. along the top edge of the space of the bag body 2 as known in the art.

A clasp 25 is provided on the top right corner of the bag body 2 (see part FIG. 1A of FIG. 1). The clasp 25 comprises an oval frame 251 and a flexible member (e.g., fabric) 252 interconnecting the bag body 2 and the frame 251.

Each of the first and second carrying handles 3, 4 are formed of fabric and shaped as an arc. The first carrying handle 3 has both ends secured to an upper portion of the first surface 21 by stitching. A clasp 31 is provided on the first carrying handle 3 and comprises an oval frame 311 and a flexible member (e.g., fabric) 312 interconnecting the first carrying handle 3 and the frame 311. One end of the chest strap 5 can be attached to the first carrying handle 3 by releasably secured to the clasp 31.

Likewise, the second carrying handle 4 has both ends secured to an upper portion of the second surface 22 by stitching. A clasp 41 is provided on the second carrying handle 4 and comprises an oval frame 411 and a flexible member (e.g., fabric) 412 interconnecting the second carrying handle 4 and the frame 411. One end of the chest strap 5 can be attached to the second carrying handle 4 by releasably secured to the clasp 41.

The chest strap 5 comprises a rectangular, elongated strap member 51, a first buckle 52 at one end, a second buckle 53 at the other end, and a length adjustment member 54 on the strap member 51 adjacent to the second buckle 53. The second buckle 53 can be attached to the second carrying handle 4 in a different configuration of the bag 1 (see FIG. 2). The first buckle 52 comprises a D-shaped frame 522 and a member 521 interconnecting the frame 522 and a second half section 512 of the strap member 51. Likewise, the second buckle 53 comprises a D-shaped frame 532 and a member 531 interconnecting the frame 532 and a first half section 511 of the strap member 51. As shown in FIG. 1, the frame 522 and the frame 532 are attached to the frame 251.

The length adjustment member 54 is a rectangular frame with the strap member 51 passing through. A length of the chest strap 5 can be adjusted by looping the strap member 51 through the length adjustment member 54 a desired number of times.

The strap retaining member 6 is secured to the bottom left corner of the bag body 2 (see FIG. 2). The strap retaining member 6 is made of plastic and comprises the slit 61. The strap retaining member 6 is shaped as an L when viewing from a front end. The slit 61 is sized to allow the chest strap 5 to frictionally pass so that the bag body 2 is prevented from slipping from the bottom left corner of the bag body 2 (i.e., for stability purpose).

As shown in FIG. 2, the frame 522 is attached to the frame 251 and the frame 532 is attached to the frame 411. As shown in FIG. 3, in a first configuration the first and second carrying handles 3, 4 are worn over one shoulder of a person H (i.e., the bag being used as a shoulder bag). As shown in FIG. 4, in a second configuration the first and second carrying handles 3, 4 are worn over one shoulder of the person H with the chest strap 5 winding around the chest resting the bag on the back (i.e., the bag being used as a sling bag). It is envisaged by the invention that articles stored in the bag body 2 can be held without vibration.

As shown in FIG. 5A and FIG. 5B of FIG. 5, a holed clasp 76 is provided at one end of the strap member 51 and a stud 71 is provided on the bag body 2, the stud 71 being adapted to attached to the holed clasp 76 for fastening; a holed clasp 75 is provided at the other end of the strap member 51 and a stud 72 is provided on the bag body 2, the stud 72 being adapted to attach to the holed clasp 75 for fastening; and first and second studs 73, 74 are provided on the first carrying handle 3 and the second carrying handle 4 respectively. As shown in FIG. 5C of FIG. 5, the second stud 74 is attached to the holed clasp 76 in a first configuration.

As shown in FIG. 6A and FIG. 6B of FIG. 6, a male clip element 90 is provided at one end of the strap member 51 and a female clip element 82 is provided on the bag body 2, the female clip element 82 being adapted to receive the male clip element 90 for fastening; a male clip element 89 is provided at the other end of the strap member 51 and a female clip element 84 is attached to a flexible member 83 which is in turn secured to the bag body 2, the female clip element 84 being adapted to receive the male clip element 89 for fastening; a first female clip element 88 is attached to a flexible member 87 which is in turn secured to the second carrying handle 4; and a second female clip element 86 is attached to a flexible member 85 which is in turn secured to the first carrying handle 3. As shown in FIG. 6C of FIG. 6, the male clip element 90 is inserted into the first female clip element 88 in a first configuration.

As shown in of FIG. 7, a closed frame 92 is provided on a bottom right corner of the bag body 2; a closed frame 91 is provided on a top left corner of the bag body 2; and the chest strap 5 comprises the strap member 51, a second strap member 55, a male hook and loop fabric fastener 561, and a female hook and loop fabric fastener 562 together with the male hook and loop fabric fastener 561 forming a Velcro fastener 56. A person may easily press the male hook and loop fabric fastener 561 and the female hook and loop fabric fastener 562 together to temporarily fasten them together. To the contrary, when separated by pulling or peeling the two surfaces apart, the Velcro fastener 56 is unfastened. This enables a quick adjustment of the tightness of the chest strap 5 when the bag body is worn by a person.

As shown in FIG. 8, the chest strap 5 has one end attached to a closed frame 91 at a top corner, passing a closed frame 92 at a bottom corner, and the other end formed with a Velcro fastener such as the one discussed in FIG. 7. The Velcro fastener is wrapped around at one of the first and second carrying handles 3, 4 prior to fastening.

Referring to FIGS. 9 and 10, a sling bag 1 in accordance with a second preferred embodiment of the invention is shown in which FIG. 9 includes parts FIG. 9A, FIG. 9B, FIG. 9C and FIG. 9D each being a plan view of a sling bag according to a second preferred embodiment of the invention but viewing from a first surface, an opposite second surface, the first surface, and the second surface of the bag respectively; and FIG. 10 includes parts FIG. 10A, FIG. 10B, FIG. 10C and FIG. 10D each being a plan view of the sling bag showing four states of another configuration of the second preferred embodiment of the sling bag of the invention respectively. The characteristics of the second preferred embodiment are detailed below.

A closed frame 92 is provided at a bottom corner of the bag body 2. A male clip element 53 is provided at one end of the chest strap 5 and the other end of the chest strap 5 passes through the frame 92. A second female clip element 25 is provided on a top corner of the bag body 2. A female clip element 41 is provided on the second carrying handle 4. The male clip element 53 can be inserted into the female clip element 41 for attachment (see part FIG. 9C or FIG. 9) or the female clip element 25 for attachment (see part FIG. 9B of FIG. 9). The other end of the chest strap 5 can be inserted into the female clip element 41 for attachment after passing the frame 92 (see part FIG. 9D of FIG. 9).

Alternatively, as shown in FIG. 10, three apertures 58 are provided near one end of the chest strap 5 and three projecting enlargements 93 are provided near the other end of the chest strap 5. The enlargements 93 are adapted to insert into the apertures 58 for attachment (see part FIG. 10B of FIG. 10). The other end of the chest strap 5 can be inserted into the female clip element 41 for attachment after passing the frame 92 (see parts FIG. 10C and FIG. 10D of FIG. 10).

Referring to FIGS. 11 and 12, a sling bag 1 in accordance with a third preferred embodiment of the invention is shown in which FIG. 11 includes parts FIG. 11A, FIG. 11B, FIG. 11C and FIG. 11D each being a plan view of a sling bag according to a third preferred embodiment of the invention but viewing from a first surface, an opposite second surface, the first surface, and the second surface of the bag respectively; and FIG. 12 includes parts FIG. 12A, FIG. 12B, FIG. 12C and FIG. 12D each being a plan view of the sling bag showing four states of another configuration of the third preferred embodiment of the sling bag of the invention respectively. The characteristics of the third preferred embodiment are detailed below.

Figure 11A:
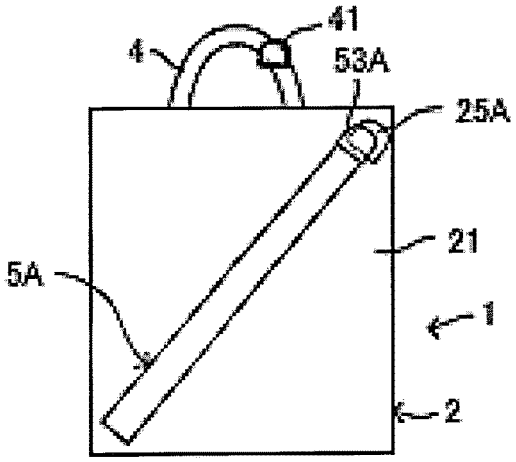
FIG. 11 including parts FIG. 11A, FIG. 11B, FIG. 11C and FIG. 11D each are a plan view of a sling bag according to a third preferred embodiment of the invention but viewing from a first surface, an opposite second surface, the first surface, and the second surface of the bag respectively.
Figure 11B:
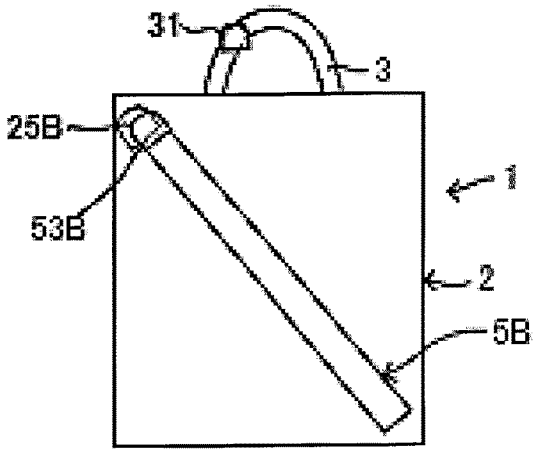
Figure 11C:
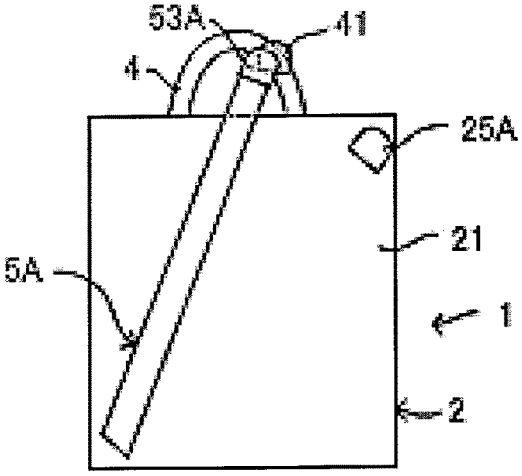
Figure 11D:
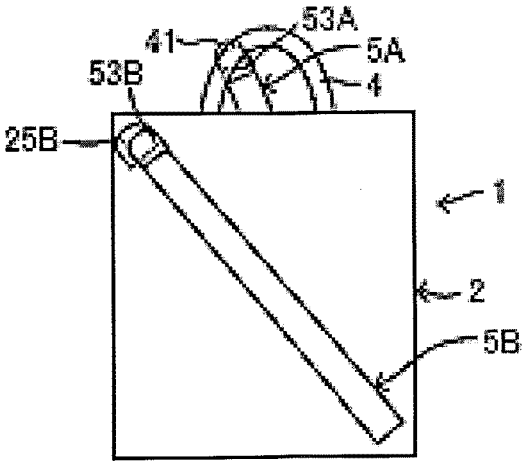
Figure 12A:
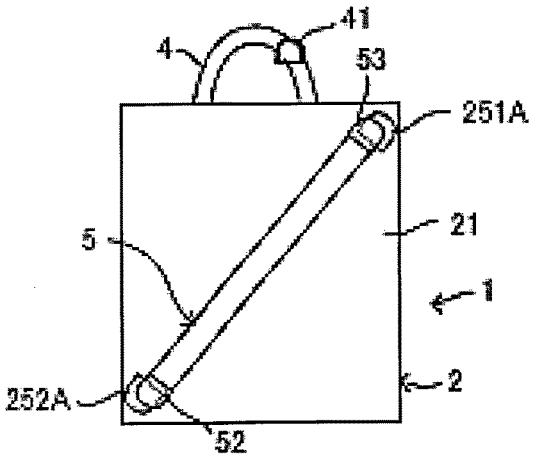
FIG. 12 including parts FIG. 12A, FIG. 12B, FIG. 12C and FIG. 12D each are a plan view of the sling bag showing four states of another configuration of the third preferred embodiment of the sling bag of the invention respectively.
Figure 12B:
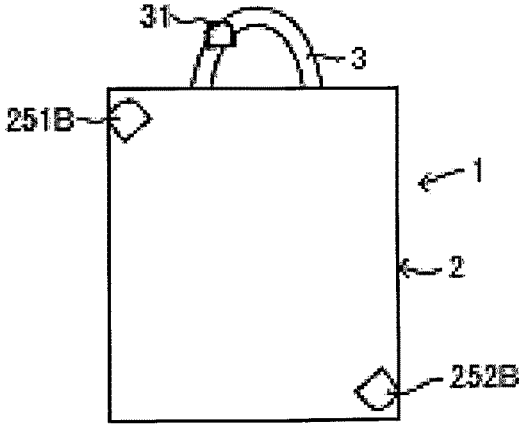
Figure 12C:
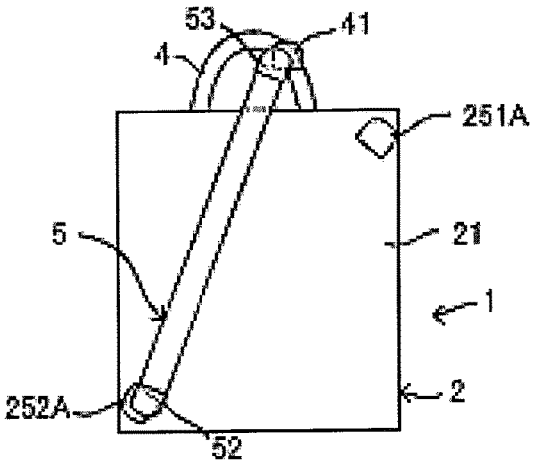
Figure 12D:
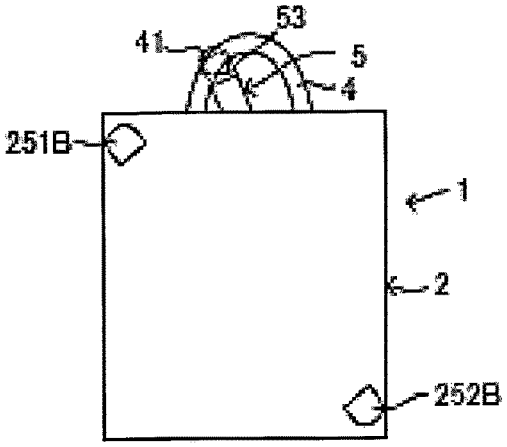

The strap retaining member is eliminated. A first chest strap 5A is provided on the first surface 21 and a second chest strap 5B is provided on the second surface 22 respectively. As shown in FIG. 11, a female clip element 25A is provided on a top corner of the first surface 21. The first chest strap 5A has one end secured to a bottom corner of the first bag body surface 21 and the other end formed as a male clip element 53A adapted to receive in the female clip element 25A for attachment. A female clip element 25B is provided on a top corner of the second surface 22. The second chest strap 5B has one end secured to a bottom corner of the second surface 22 and the other end formed as a male clip element 53B adapted to receive in the female clip element 25B for attachment. The first carrying handle 3 has a female clip element 31 and the second bag body 4 has a female clip element 41 respectively. As shown in FIG. 11D of FIG. 11, the male clip element 53A is received in the female clip element 41 for attachment. As shown in FIG. 11D of FIG. 11, the male clip element 53B is received in the female clip element 25B for attachment and the male clip element 53A is received in the female clip element 41 for attachment respectively.

Alternatively, as shown in FIG. 12, a first female clip element 251A is provided on a top corner of the first surface 21 and a second female clip element 252A is provided on a bottom corner of the first surface 21, being diagonally oriented with respect to the first female clip element 251A. A third female clip element 251B is provided on a top corner of the second surface 22 and a fourth female clip element 252B is provided on a bottom corner of the second surface 22, being diagonally oriented with respect to the third female clip element 251B. The first carrying handle 3 has a female clip element 31 and the second bag body 4 has a female clip element 41 respectively. As shown in FIG. 12A of FIG. 12, the chest strap 5 has one end formed as a male clip element 52 adapted to releasably receive in the second female clip element 252 and the other end formed as a male clip element 53 adapted to releasably receive in the first female clip element 251 both for attachment. As shown in FIG. 12D of FIG. 12, the male clip element 53 is received in the female clip element 41 for attachment and the male clip element 52 is received in the female clip element 41 for attachment respectively.

Figure 13A:
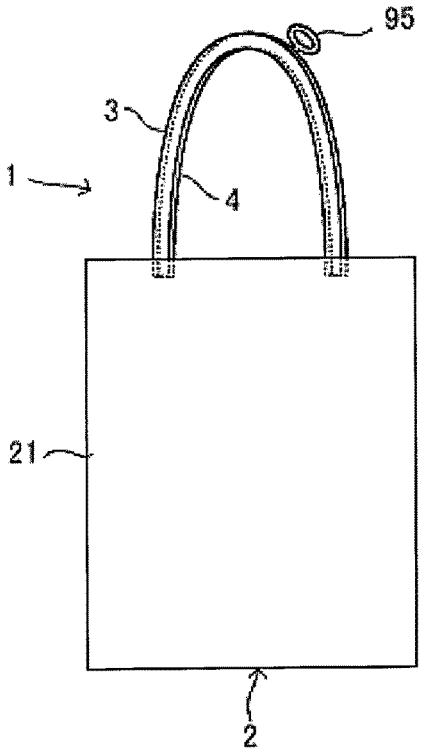
FIG. 13 including parts FIG. 13A, FIG. 13B and FIG. 13C each are a plan view of a sling bag according to a fourth preferred embodiment of the invention but viewing from a first surface, an opposite second surface, and the second surface of the bag respectively.
Figure 13B:
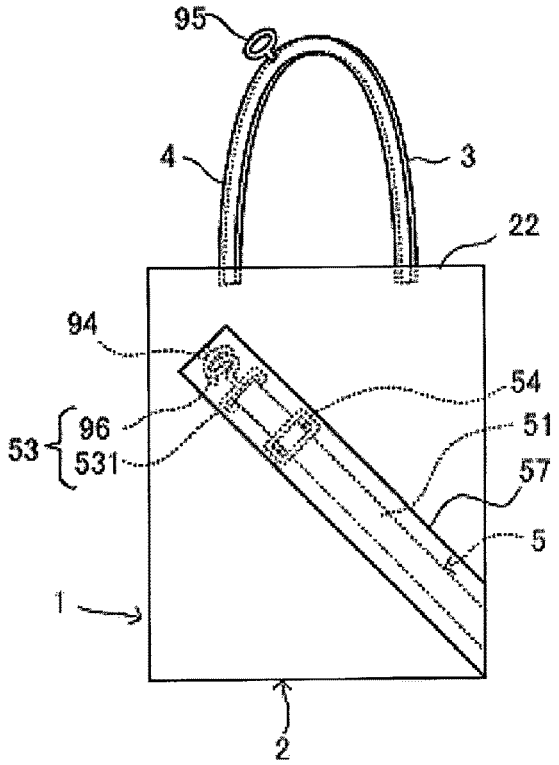
Figure 13C:
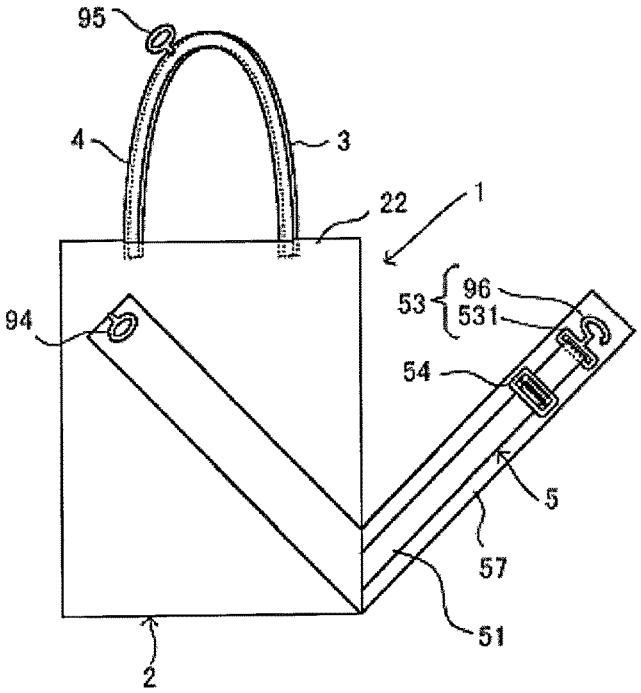
Figure 14A:
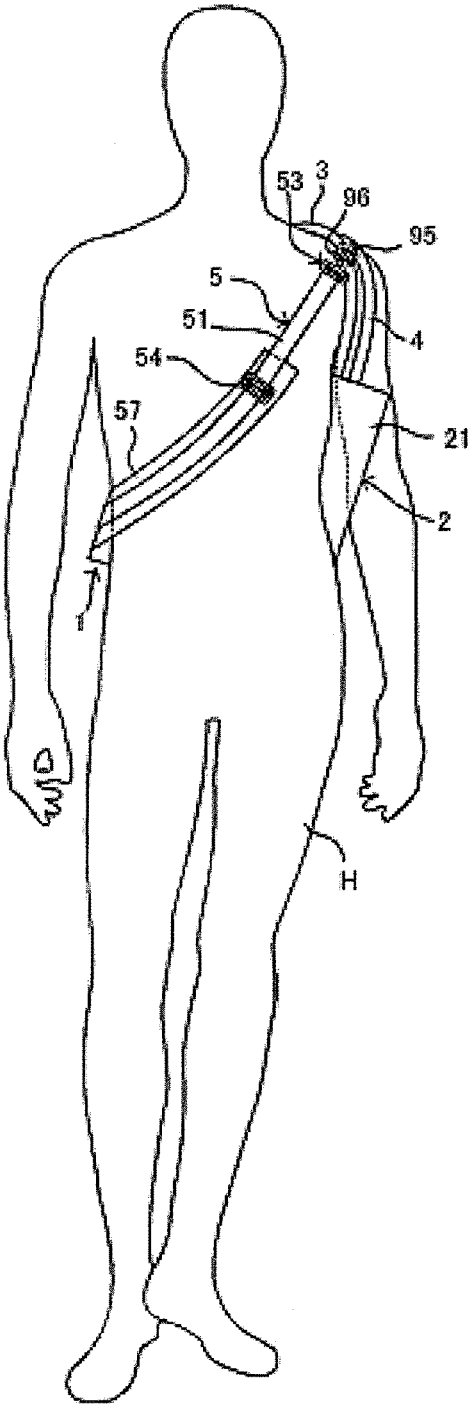
FIG. 14 including parts FIG. 14A and FIG. 14B each are a plan view of a person wearing the bag of the fourth preferred embodiment of the invention on his shoulder and winding around the chest and the back but viewing from the front and the back of the person respectively.
Figure 14B:
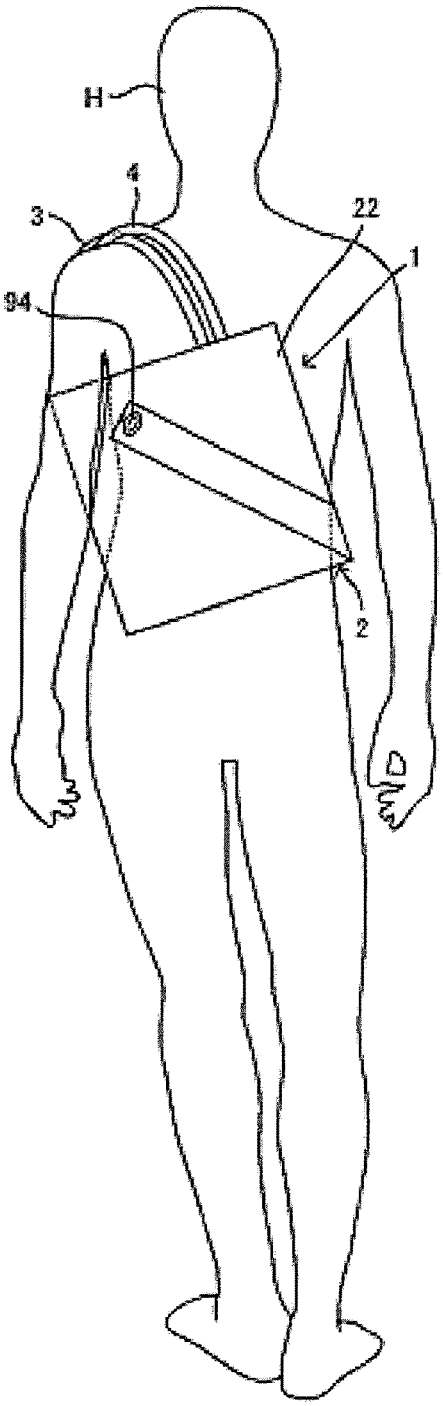

Referring to FIGS. 13 and 14, a sling bag 1 in accordance with a fourth preferred embodiment of the invention is shown in which FIG. 13 includes parts FIG. 13A, FIG. 13B and FIG. 13C each being a plan view of a sling bag according to a fourth preferred embodiment of the invention but viewing from a first surface, an opposite second surface, and the second surface of the bag respectively; and FIG. 14 includes parts FIG. 14A and FIG. 14B each being a plan view of a person wearing the bag of the fourth preferred embodiment of the invention on his shoulder and winding around the chest and the back but viewing from the front and the back of the person respectively. The characteristics of the fourth preferred embodiment are detailed below.

As shown in FIG. 13, a ring 95 is provided on the first carrying handle 3; a ring 94 is provided on the second surface 22 of the bag body 2 near a top corner of the second surface 22; an attachment unit 53 including a hook 96 adapted to releasably secure to the ring 94, and a frame 531 provided at one end of a strap member 51; a length adjustment member 54 is provided on the strap member 51; and a fabric strip 57 is provided for covering the chest strap 5. Alternatively, the fabric 57 is secured to the bag body 2 by stitching.

As shown in FIG. 14, in use the first and second carrying handles 3, 4 may be worn over one shoulder of a person H with the chest strap 5 winding around the chest and the back. Further, the strap member 51 is pulled out of the fabric strip 57 so that the hook 96 can be attached to the ring 95 for fastening.

Figure 15A:
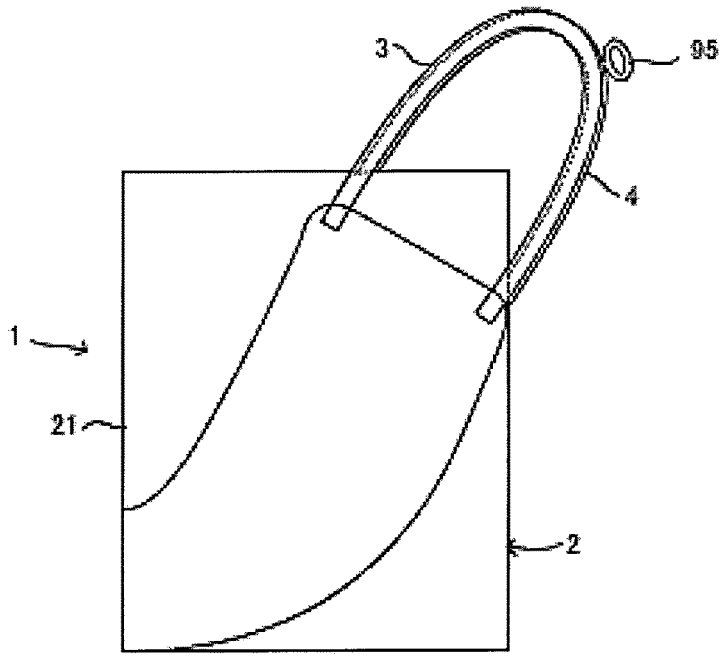
FIG. 15 including parts FIG. 15A and FIG. 15B each are a plan view of a sling bag according to a fifth preferred embodiment of the invention but viewing from a first surface and an opposite second surface of the bag respectively.
Figure 15B:
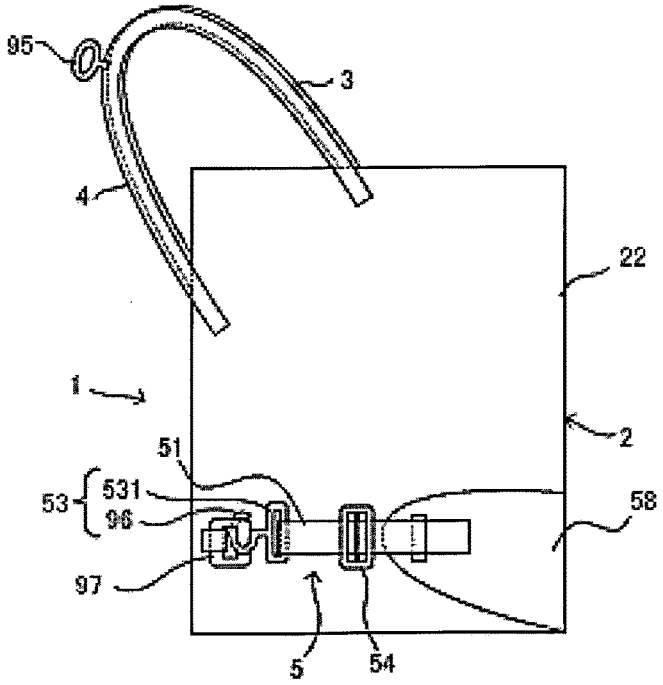
Figure 16A:
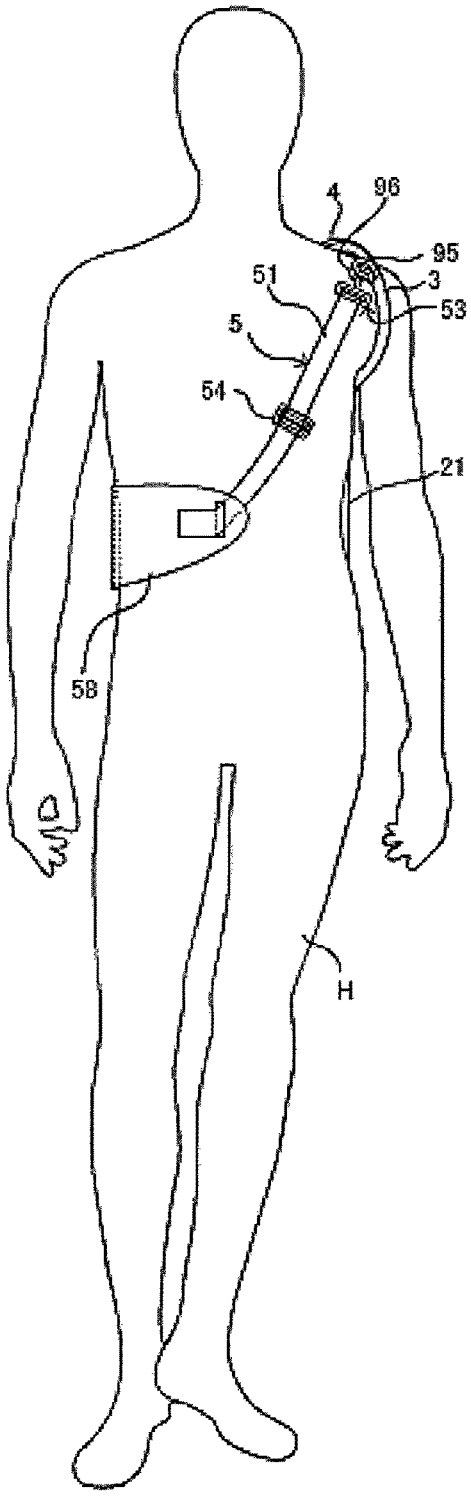
FIG. 16 including parts FIG. 16A and FIG. 16B each are a plan view of a person wearing the bag of the fifth preferred embodiment of the invention on his shoulder and winding around the chest and the back but viewing from the front and the back of the person respectively.
Figure 16B:
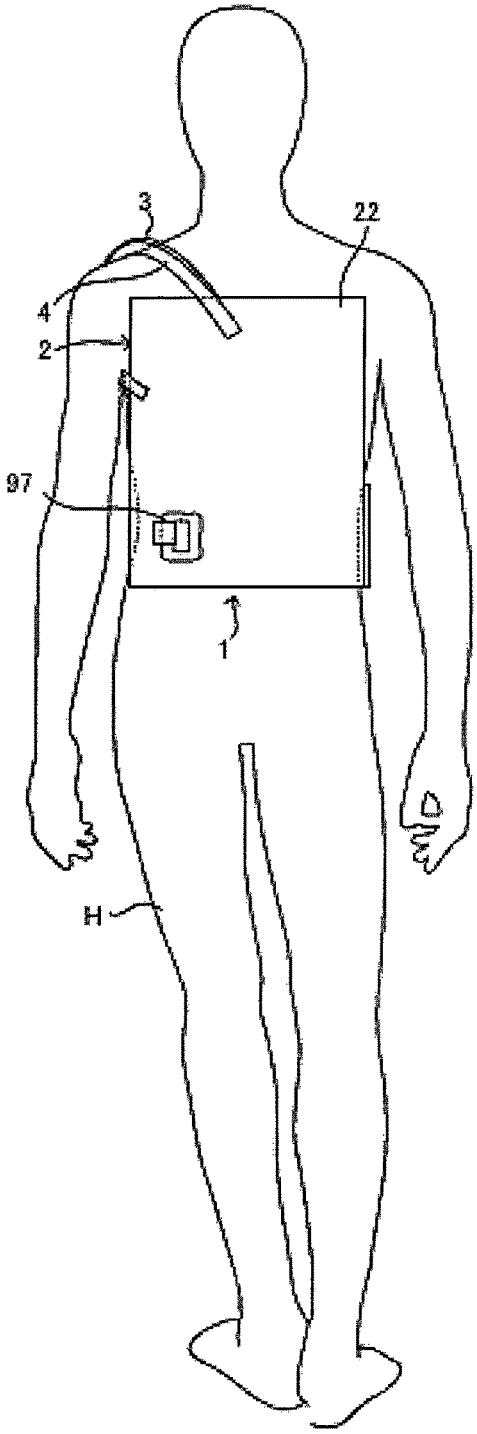

Referring to FIGS. 15 and 16, a sling bag 1 in accordance with a fifth preferred embodiment of the invention is shown in which FIG. 15 includes parts FIG. 15A and FIG. 15B each being a plan view of a sling bag according to a fifth preferred embodiment of the invention but viewing from a first surface and an opposite second surface of the bag respectively; and FIG. 16 includes parts FIG. 16A and FIG. 16B each being a plan view of a person wearing the bag of the fifth preferred embodiment of the invention on his shoulder and winding around the chest and the back but viewing from the front and the back of the person respectively. The characteristics of the fifth preferred embodiment are detailed below.

The strap retaining member 6 and the clasp 31 are eliminated. A large fabric 581 has a diagonally oriented major portion provided on the first surface 21 and a minor portion formed as a flap secured to a bottom corner of the second surface 22. The chest strap 5 comprises a strap member 51 having one end attached to the flap of the large fabric 581 and the other end secured to a rectangular frame 531. A length adjustment member 54 is provided to allow the strap member 51 to pass through. A hook 96 is integrally formed with the frame 531 and together they form an attachment unit 53. A ring 97 is pivotably secured to the second surface 22 proximate to the bottom corner. A ring 95 is provided on the second carrying handle 4.

As shown in FIG. 16, in use the first and second carrying handles 3, 4 may be worn over one shoulder of a person H with the strap member 51 being disposed over the chest so that the hook 96 can be attached to the ring 95 for fastening.

Figure 17A:
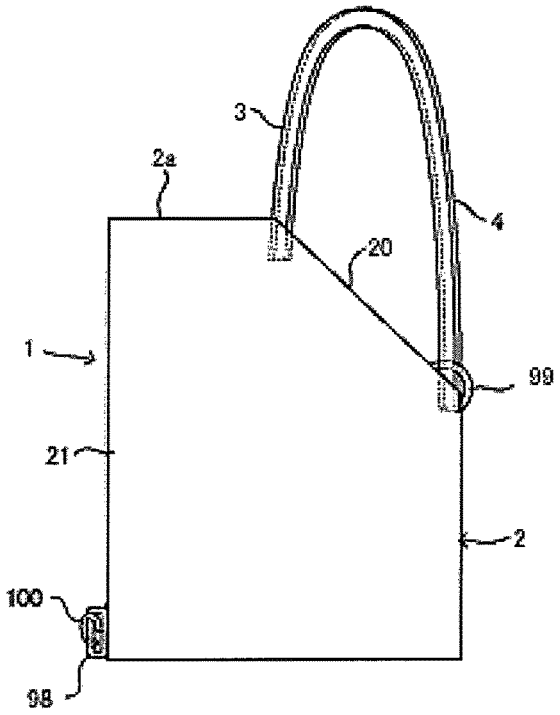
FIG. 17 including parts FIG. 17A and FIG. 17B each are a plan view of a sling bag according to a sixth preferred embodiment of the invention but viewing from a first surface and an opposite second surface of the bag respectively.
Figure 17B:
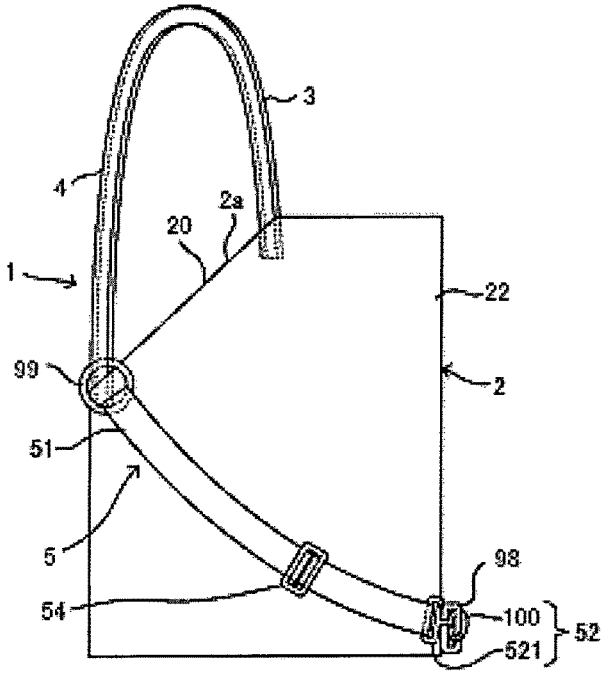
Figure 18A:
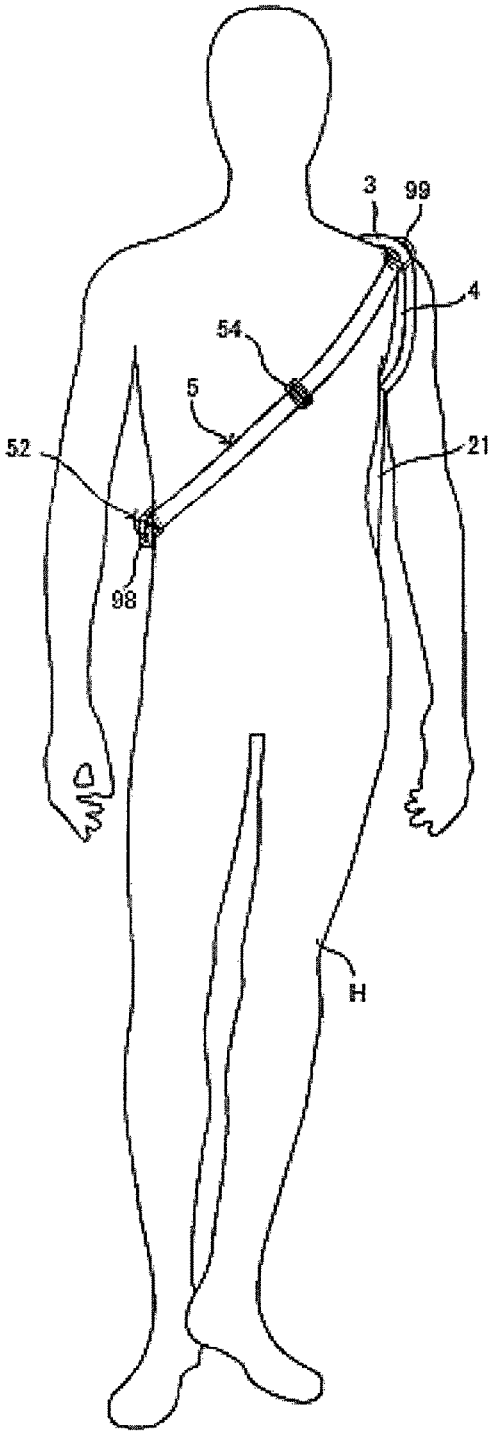
FIG. 18 including parts FIG. 18A and FIG. 18B each are a plan view of a person wearing the bag of the sixth preferred embodiment of the invention on his shoulder and winding around the chest and the back but viewing from the front and the back of the person respectively.
Figure 18B:
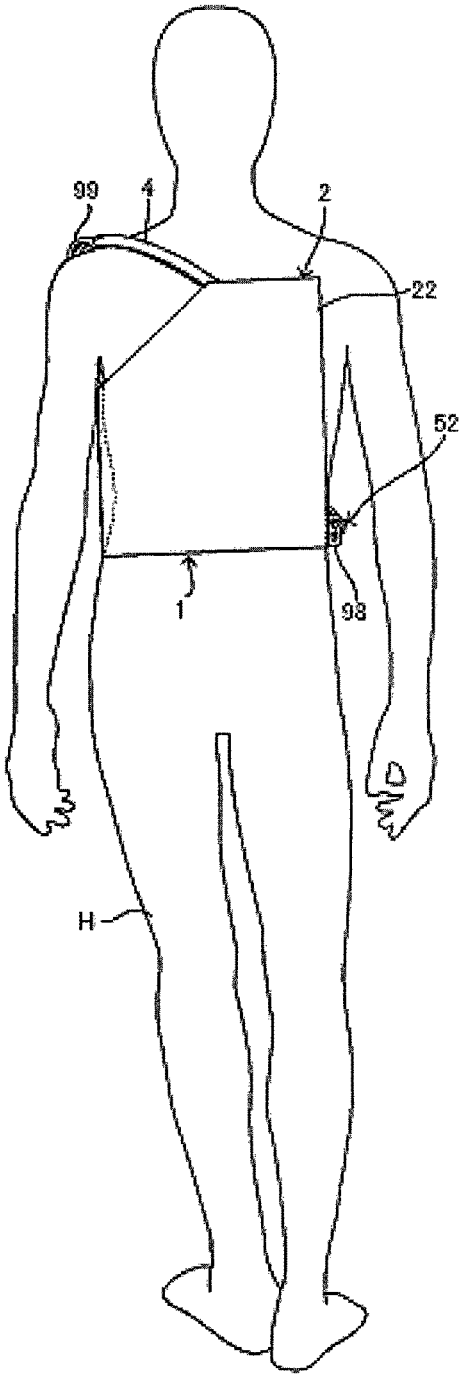

Referring to FIGS. 17 and 18, a sling bag 1 in accordance with a sixth preferred embodiment of the invention is shown in which FIG. 17 including parts FIG. 17A and FIG. 17B each being a plan view of a sling bag according to a sixth preferred embodiment of the invention but viewing from a first surface and an opposite second surface of the bag respectively; and FIG. 18 includes parts FIG. 18A and FIG. 18B each being a plan view of a person wearing the bag of the sixth preferred embodiment of the invention on his shoulder and winding around the chest and the back but viewing from the front and the back of the person respectively. The characteristics of the sixth preferred embodiment are detailed below.

The strap retaining member 6 and the clasp 31 are eliminated. A closed inclined portion 20 is provided on a top edge of the bag body 2. Each of the first and second carrying handles 3, 4 have one end terminated at one end of the inclined portion 20 and the other end terminated at the other end of the inclined portion 20. An opening 2*a* is provided between one end (i.e., the upper end) of the inclined portion 20 and a top left corner of the bag body 2 (see part FIG. 17A of FIG. 17). A large ring 99 is provided at the other end (i.e., the lower end) of the inclined portion 20. A rectangular frame 98 is provided at a bottom corner of the bag body 2 being oriented diagonally with respect to the large ring 99. A small ring 98 loops around the frame 98. The chest strap 5 comprises a strap member 51 having one end attached to the small ring 98 and the other end formed as an attachment unit 52 including a frame 521 attached to the strap member 51 and a hook 100 integrally formed with the frame 521. A length adjustment member 54 is provided to allow the strap member 51 to pass through. The hook 100 is adapted to releasably secure to the small ring 98 for attachment.

As shown in FIG. 18, in use the first and second carrying handles 3, 4 may be worn over one shoulder of a person H with the strap member 51 being disposed over the chest so that the hook 100 can be attached to the small ring 98 for fastening.

It is envisaged by the invention that the sling bag can be stably worn on a person. Further, it is adjustable with respect to strap length and fastening arrangement. Furthermore, a number of different configurations are available for user selection.

It is also envisaged by the invention that the two carrying handles can be replaced with a single one.

While the invention has been described in terms of preferred embodiments, those skilled in the art will recognize that the invention can be practiced with modifications within the spirit and scope of the appended claims.

What is claimed is:

1. A sling bag comprising:

a rectangular bag body consisting of a planar first wall and an opposite planar second wall contacting each other and connected along a perimeter so as to form a space defined by the first and second walls for containing articles, the space having an opening;

a first carrying handle having two opposite ends with each end of the first carrying handle secured to an upper edge of the first wall and configured to wear over a single shoulder of a wearer and comprising a first clasp attached intermediate the two opposite ends;

a second carrying handle having two opposite ends with each end of the second carrying handle secured to an opposite upper edge of the second wall and configured to wear over the single shoulder of the wearer and comprising a second clasp attached intermediate the two opposite ends;

a third clasp attached to a first upper corner of the bag body;

a strap retaining member attached to a second diagonally opposite lower corner of the bag body; and a single continuous diagonally extending chest strap having a first buckle attached at a first end of the chest strap and attached to the third clasp, passing through the strap retaining member, and an opposite second buckle attached at an opposite second end of the chest strap and attached to one of the first, second, and third clasps such that the single chest strap extends diagonally across both of the first and second walls and is configured to wear over the single shoulder of the wearer.

2. A sling bag comprising:

a rectangular bag body consisting of a planar first wall and an opposite planar second wall, contacting each other and connected along a perimeter so as to form a space defined by the first and second walls for containing articles, the space having an opening;

a first carrying handle having two opposite ends with each end of the first carrying handle secured to an upper edge of the first wall and configured to wear over a single shoulder of a wearer and comprising a first clip attached intermediate the two opposite ends;

a second carrying handle having two opposite ends with each end of the second carrying handle secured to an opposite upper edge of the second wall and configured to wear over the single shoulder of the wearer and comprising a second clip attached intermediate the two opposite ends;

a third clip attached to the first wall adjacent a first upper corner of the first wall;

a fourth clip attached to the second wall adjacent a second adjacent upper corner of the second wall;

a first diagonally extending chest strap having a first end attached adjacent an opposite lower corner of the first wall and an opposite second end releasably attachable to both of the first and third clips such that the first chest strap extends diagonally across the first wall; and a second diagonally extending chest strap having a first end attached adjacent the opposite lower corner of the second wall and an opposite second end releasably attachable to both of the second and fourth clips such that the second chest strap extends diagonally across the opposite second wall.

* * * * *